US010808456B2

(12) United States Patent
Chen

(10) Patent No.: US 10,808,456 B2
(45) Date of Patent: Oct. 20, 2020

(54) BLIND BODY ACTUATOR CASING FOR NON-PULL CORD WINDOW BLIND ASSEMBLY

(71) Applicant: SHEEN WORLD TECHNOLOGY CORPORATION, Taichung (TW)

(72) Inventor: Po-Yu Chen, Taichung (TW)

(73) Assignee: SHEEN WORLD TECHNOLOGY CORPORATION, Taichung (TW)

( * ) Notice: Subject to any disclaimer, the term of this patent is extended or adjusted under 35 U.S.C. 154(b) by 0 days.

(21) Appl. No.: 15/888,673

(22) Filed: Feb. 5, 2018

(65) Prior Publication Data

US 2018/0363369 A1 Dec. 20, 2018

(51) Int. Cl.
*E06B 9/322* (2006.01)
*B65H 75/34* (2006.01)

(52) U.S. Cl.
CPC ..... *E06B 9/322* (2013.01); *B65H 75/34* (2013.01); *E06B 2009/3222* (2013.01)

(58) Field of Classification Search
CPC . E06B 9/382; E06B 9/322; E06B 9/68; E06B 2009/322; E06B 2009/3227; B65H 57/00; B65H 57/02; B65H 57/16; B65H 57/26; B65H 75/4402; B65H 75/4405; B65H 79/00; B65H 75/34; B65H 75/02
USPC ..... 160/170
See application file for complete search history.

(56) References Cited

U.S. PATENT DOCUMENTS 6,761,203 B1 * 7/2004 Huang ..... E06B 9/322 160/170
9,714,538 B2 * 7/2017 Huang ..... E06B 9/322
2007/0151675 A1 * 7/2007 Nien ..... E06B 9/30 160/84.05
2012/0193461 A1 * 8/2012 Lin ..... E06B 9/322 242/371
2015/0275573 A1 * 10/2015 Huang ..... E06B 9/322 160/192
2016/0123073 A1 * 5/2016 Chen ..... E06B 9/34 160/170
2016/0123447 A1 * 5/2016 Chen ..... F16H 31/001 160/168.1 P
2016/0340975 A1 * 11/2016 Huang ..... E06B 9/322
2017/0081912 A1 * 3/2017 Guillory ..... E06B 9/26
2017/0107075 A1 * 4/2017 Hung ..... B65H 75/4405
2017/0211321 A1 * 7/2017 Chen ..... E06B 9/262

* cited by examiner

*Primary Examiner* — Daniel P Cahn
(74) *Attorney, Agent, or Firm* — Browdy and Neimark, PLLC

(57) ABSTRACT

A blind body actuator casing includes a plastic top panel defining a bottom wall, a plastic bottom panel defining a top wall and detachably fastened to the plastic top panel with a predetermined interval defined between the bottom wall of the plastic top panel and the top wall of the plastic bottom panel, and a plurality of metal wheel axles connected between the bottom wall of the plastic top panel and the top wall of the plastic bottom panel. Thus, the invention effectively reduces noises during rotation of rotary components that are mounted on the metal wheel axles.

3 Claims, 4 Drawing Sheets

BLIND BODY ACTUATOR CASING FOR NON-PULL CORD WINDOW BLIND ASSEMBLY

BACKGROUND OF THE INVENTION

1. Field of the Invention

The present invention relates to window blind technology and more particularly, to a blind body actuator casing for non-pull cord window blind assembly.

2. Description of the Related Art

In regular window blinds, the blind body can be extended out or received subject to the operation of a lift-cord through the functioning of a blind body actuator. When the lift-cord winding wheels are rotated by an external force, the lift-cord winding wheels would take up the lift-cord and further pull up the bottom rail and the slats, receiving the blind body to the headrail.

However, during the operation, due to material difference, manufacturing tolerance or wear problem, the rotation of the lift-cord winding wheels can produce noises, causing the user's troubles.

SUMMARY OF THE INVENTION

The present invention has been accomplished under the circumstances in view. It is the main object of the present to provide a blind body actuator casing for non-pull cord window blind assembly, which reduces noises during rotation of the mounted rotary components.

To achieve this and other objects of the present invention, a blind body actuator casing comprises a plastic top panel defining a bottom wall, a plastic bottom panel defining a top wall and detachably fastened to the plastic top panel with a predetermined interval defined between the bottom wall of the plastic top panel and the top wall of the plastic bottom panel, and a plurality of metal wheel axles connected between the bottom wall of the plastic top panel and the top wall of the plastic bottom panel. Thus, the invention effectively reduces noises during rotation of rotary components that are mounted on the metal wheel axles.

Preferably, each metal wheel axle comprises a second metal axle component and a first metal axle component. The first metal axle component has a top end thereof fixedly connected to the bottom wall of the plastic top panel. The second metal axle component has a bottom end thereof fixedly connected to the top wall of the plastic bottom panel, and an opposite top end thereof detachably connected to an opposite bottom end of the first metal axle component.

Preferably, the plastic bottom panel comprises a plurality of positioning grooves; the metal wheel axles are one-piece members, each having a top end thereof fixedly connected to the bottom wall of the plastic top panel and an opposite bottom end thereof detachably fastened to one respective positioning groove of the plastic bottom panel.

Preferably, the plastic top panel comprises a plurality of first side pillars downwardly extended from the bottom wall thereof; the plastic bottom panel comprises a plurality of second side pillars upwardly extended from the top wall thereof and detachably fastened to the respective first side pillars.

Preferably, the second metal axle component of each metal wheel axle comprises a connection recess located on a top end thereof; the first metal axle component of each metal wheel axle comprises a connection protrusion located on a bottom end thereof and detachably engaged into the connection recess of the respective second metal axle component.

Other advantages and features of the present invention will be fully understood by reference to the following specification in conjunction with the accompanying drawings, in which like reference signs denote like components of structure.

DETAILED DESCRIPTION OF THE INVENTION

Figure 1:
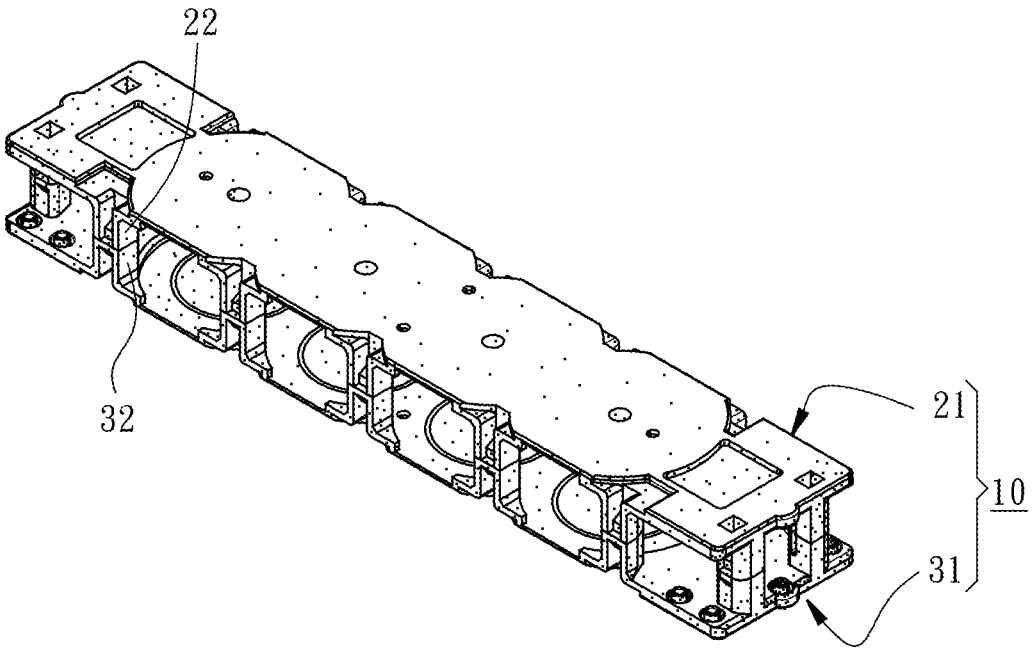
FIG. 1 is an oblique top elevational view of a blind body actuator casing in accordance with a first embodiment of the present invention.
Figure 2:
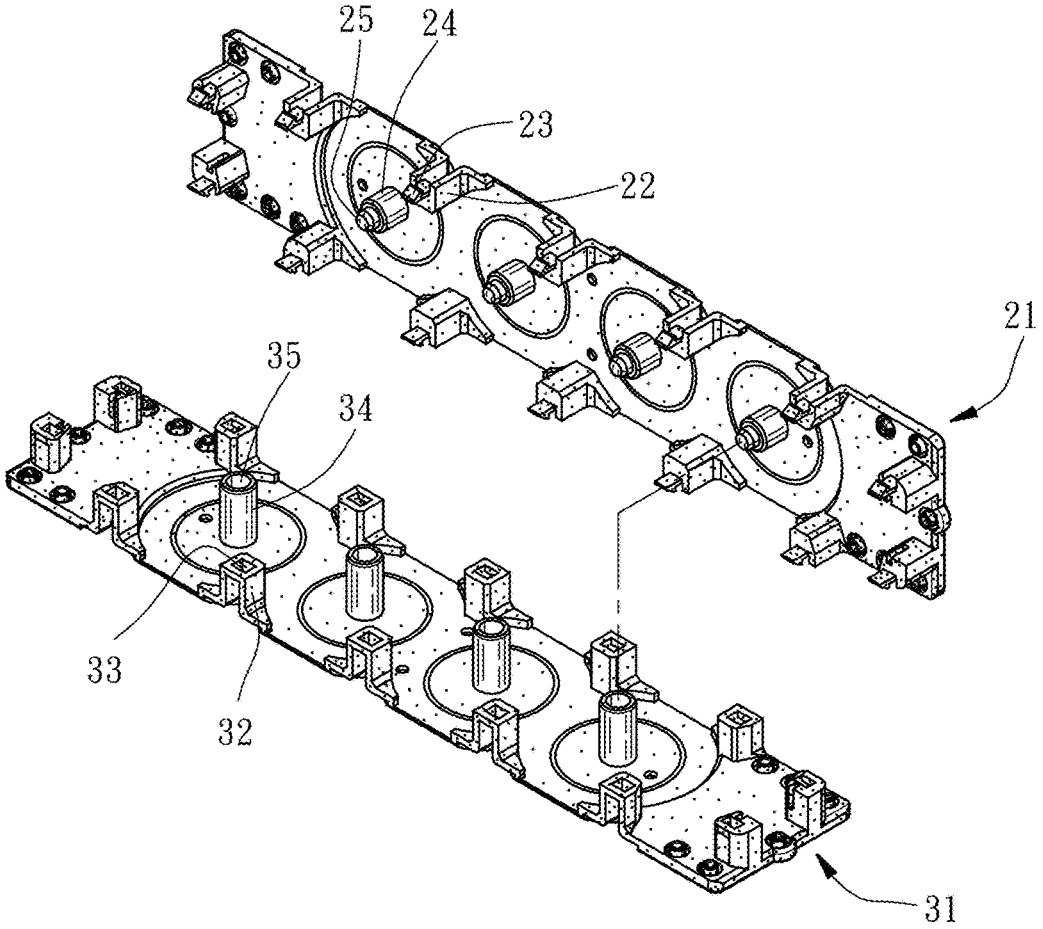
FIG. 2 is an exploded view of the blind body actuator casing in accordance with the first embodiment of the present invention.
Figure 3:
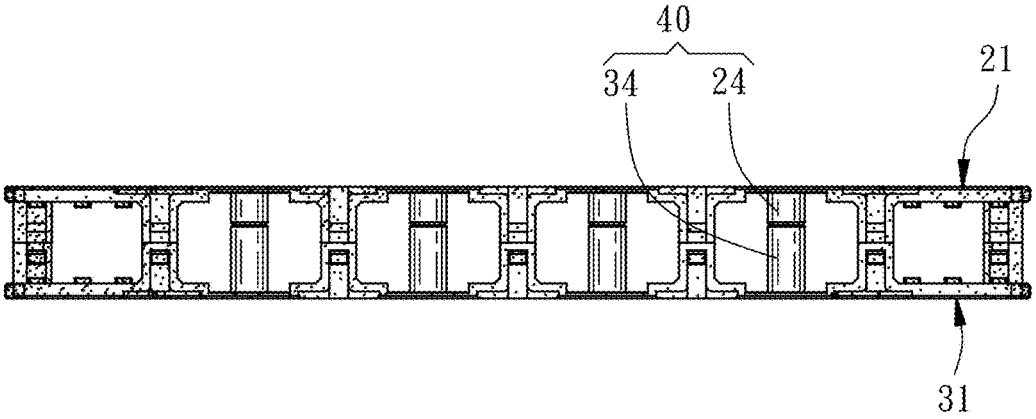
FIG. 3 is a front view of the blind body actuator casing in accordance with the first embodiment of the present invention.
Figure 4:
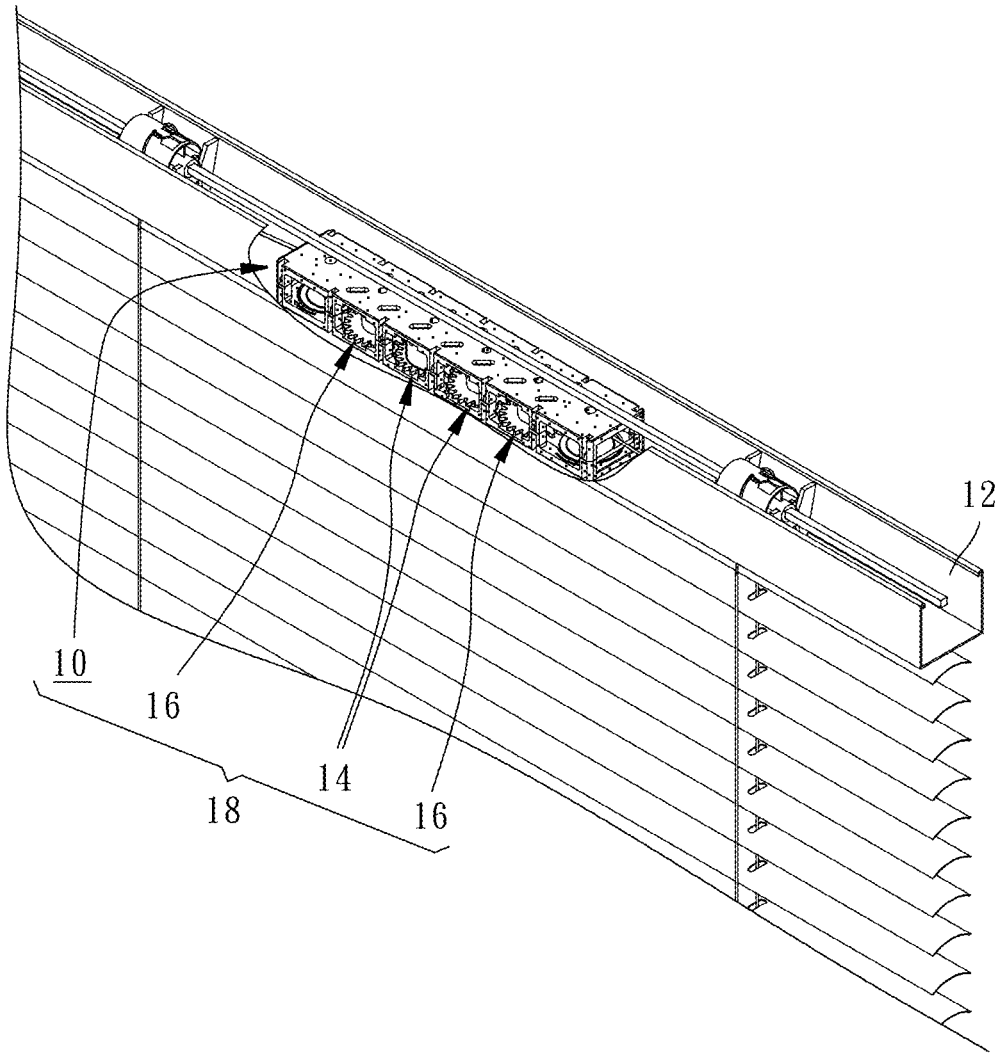
FIG. 4 illustrates the blind body actuator casing of the first embodiment of the present invention installed in the headrail of a non-pull cord window blind assembly.

Referring to FIG. 1, FIG. 2 and FIG. 3, a blind body actuator casing 10 is mounted in a headrail 12 (see FIG. 4), comprising a plastic top panel 21, an opposite plastic bottom panel 31, and four metal wheel axles 40.

The plastic top panel 21 comprises a plurality of first side pillars 22 downwardly extended from a bottom wall around the border thereof. Each first side pillar 22 comprises a hook portion 23 extended from a bottom end thereof.

The plastic bottom panel 31 comprises a plurality of second side pillars 32 upwardly extended from a top wall around the border thereof. Each second side pillars 32 comprises a hook groove 33 located on a top end thereof.

The metal wheel axles 40 are respectively composed of two components, each comprising a second metal axle component 34 and a first metal axle component 24. The first metal axle component 24 has a top end thereof fixedly fastened to the bottom wall of the plastic top panel 21 using insert molding technology. The second metal axle component 34 has a bottom end thereof fixedly fastened to the top wall of the plastic bottom panel 31 using insert molding technology. Further, the first metal axle component 24 has a connection protrusion 25 protruded from an opposite bottom end thereof; the second metal axle component 34 has a connection recess 35 located on an opposite top end thereof.

In installation, the hook portions 23 of the first side pillars 22 of the plastic top panel 21 are respectively hooked in the hook grooves 33 of the respective second side pillars 32 of the plastic bottom panel 31 to force the connection protrusions 25 of the respective first metal axle components 24 into engagement with the connection recesses 35 of the respective second metal axle components 34. After installation, the first metal axle components 24 and the second metal axle components 34 are respectively fastened together to create the respective metal wheel axles 40 that support other rotary components (such as coil spring winding wheels 14 or lift-cord winding wheels 16) to create a blind body actuator 18, avoiding generation of noises during rotation of the rotary components.

Figure 5:
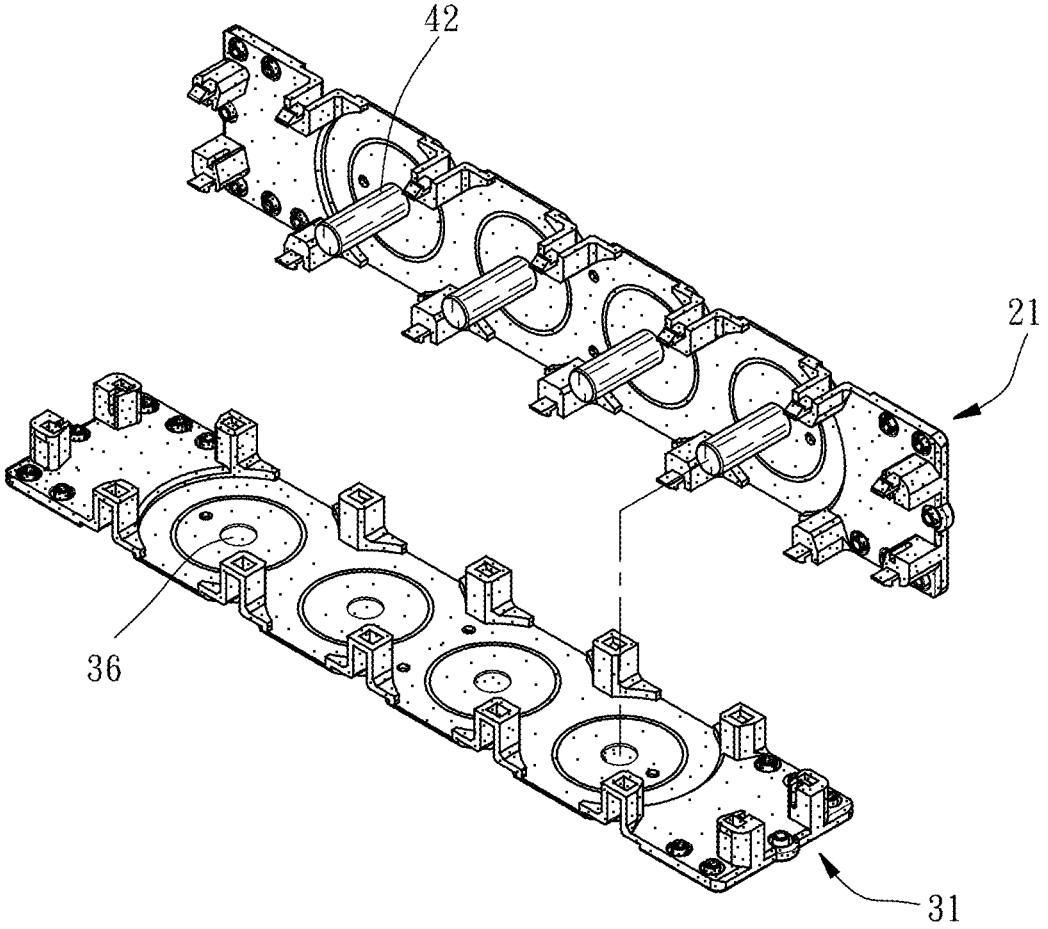
FIG. 5 is an exploded view of a blind body actuator casing in accordance with a second embodiment of the present invention.

In a second embodiment of the present invention, each metal wheel axle 42 is a one-piece member. As illustrated in FIG. 5, each metal wheel axle 42 has a top end thereof fixedly fastened to the bottom wall of the plastic top panel 21 using insert molding technology. In installation, the opposite bottom end of each metal wheel axle 42 is fastened to a respective positioning groove 36 in the top wall of the plastic bottom panel 31. This structural arrangement can also achieve the effect of noise reduction.

What is claimed is:

1. A blind body actuator casing for a non-pull cord window blind assembly, comprising:

a plastic top panel defining a bottom wall;

a plastic bottom panel defining a top wall, said plastic bottom panel being detachably fastened to said plastic top panel with a predetermined interval defined between said bottom wall of said plastic top panel and said top wall of said plastic bottom panel; and a plurality of metal wheel axles connected between said bottom wall of said plastic top panel and said top wall of said plastic bottom panel, wherein said plastic top panel and said plastic bottom panel are made of plastic and said plurality of metal wheel axles are made of metal;

wherein each of said metal wheel axles is a one-piece member;

wherein when said plastic top panel is detached from said plastic bottom panel, each of said metal wheel axles is only connected with said bottom wall of said plastic top panel;

wherein said plastic bottom panel comprises a plurality of positioning grooves; each said metal wheel axle has a top end thereof fixedly connected to said bottom wall of said plastic top panel and an opposite bottom end thereof detachably fastened to one respective said positioning groove of said plastic bottom panel;

wherein each of said metal wheel axles is extended entirely between said bottom wall of said plastic top panel and said top wall of said plastic bottom panel; and wherein said plurality of positioning grooves are in said top wall of said plastic bottom panel.

2. The blind body actuator casing as claimed in claim 1, wherein said plastic top panel comprises a plurality of first side pillars downwardly extended from the bottom wall thereof; said plastic bottom panel comprises a plurality of second side pillars upwardly extended from the top wall thereof and detachably fastened to the respective said first side pillars.

3. The blind body actuator casing as claimed in claim 2, wherein each said first side pillar comprises a hook portion; each said second side pillar comprises a hook groove detachably fastened to said hook portion of one respective said first side pillar.

* * * * *